United States Patent [19]

Hirakawa et al.

[11] Patent Number: 4,706,863

[45] Date of Patent: Nov. 17, 1987

[54] INTERMITTENT FEEDING APPARATUS FOR A CONTINUOUS SHEET

[75] Inventors: Tadashi Hirakawa; Tadashi Yano, both of Mihara, Japan

[73] Assignee: Mitsubishi Jukogyo Kabushiki Kaisha, Tokyo, Japan

[21] Appl. No.: 745,425

[22] Filed: Jun. 17, 1985

[51] Int. Cl.[4] ..... B65H 20/12; B65H 20/16

[52] U.S. Cl. ..... 226/95; 226/140

[58] Field of Search ..... 271/276, 194, 196; 226/108, 181, 178, 183, 95, 140, 155

[56] References Cited

U.S. PATENT DOCUMENTS

| | | | |
|---|---|---|---|
| 2,753,181 | 7/1956 | Anander | 226/95 |
| 3,270,932 | 9/1966 | Smith, Jr. | 226/95 |
| 4,124,156 | 11/1978 | Waffner | 226/95 X |
| 4,260,146 | 4/1981 | Mitzel | 271/276 X |
| 4,291,974 | 9/1981 | Silverberg | 226/95 X |
| 4,336,813 | 6/1982 | Seragnoli | 226/95 X |
| 4,403,847 | 9/1983 | Chrestensen | 226/95 X |

*Primary Examiner*—Stuart S. Levy
*Assistant Examiner*—Lynn M. Sohacki
*Attorney, Agent, or Firm*—Wenderoth, Lind & Ponack

[57] ABSTRACT

In a machine for working (or processing) a continuous sheet while the continuous sheet travels through the machine, an intermittent feeding apparatus for the continuous sheet is provided which has a suction roll disposed on the downstream side of the working (or processing) section for sucking and transporting the continuous sheet, adjusting means for adjusting a sheet sucking and transporting period of the suction roll, and a secution box disposed on the upstream side of the working (or processing) section for continuously exerting upon the continuous sheet a suction force that is weaker than the suction force exerted by the suction roll.

4 Claims, 22 Drawing Figures

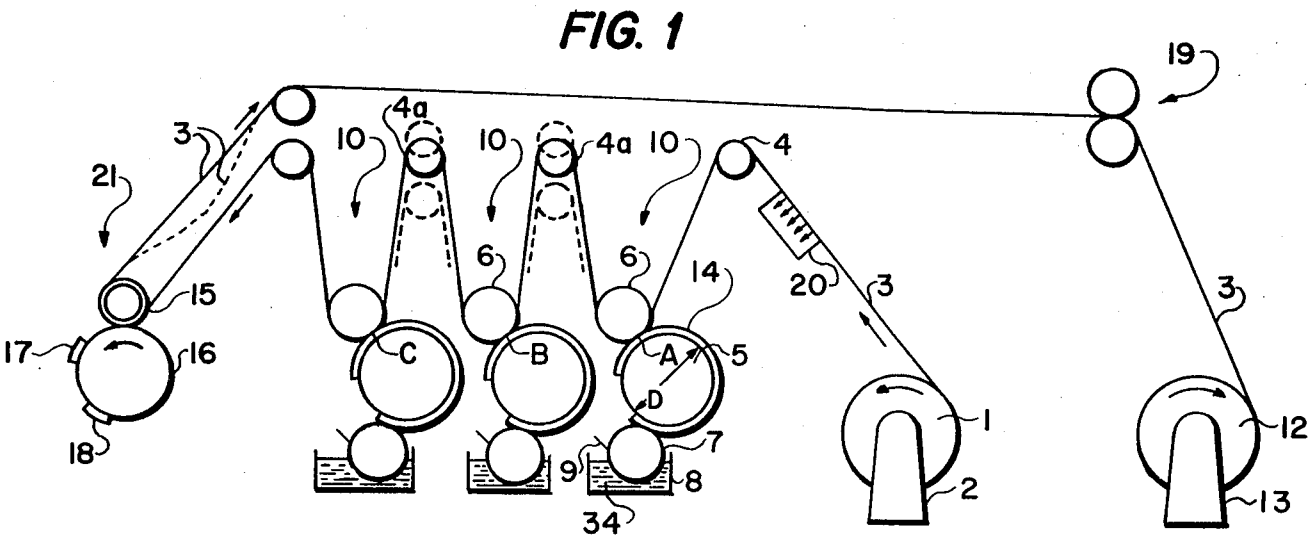
FIG. 1
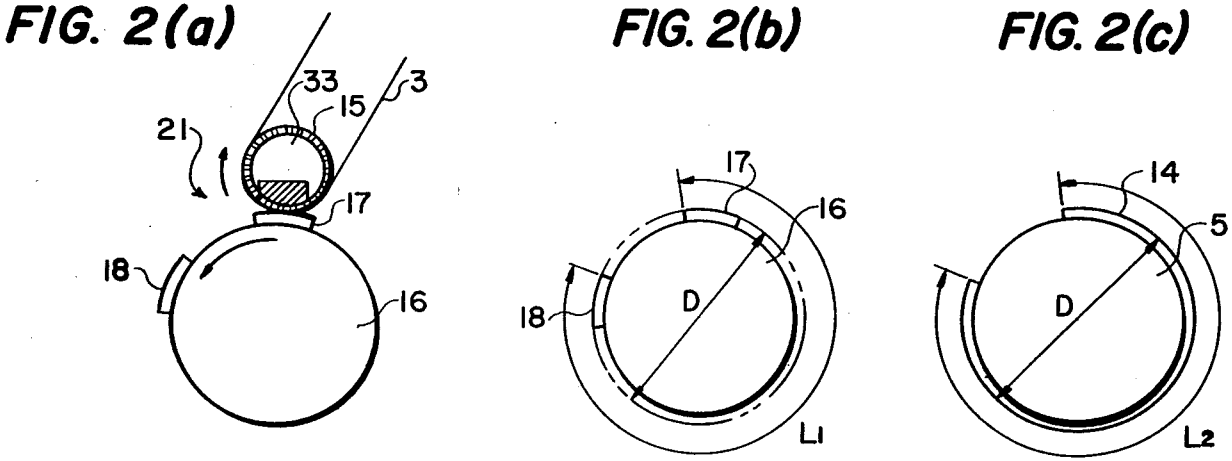
FIG. 2(a)
FIG. 2(b)
FIG. 2(c)

INTERMITTENT FEEDING APPARATUS FOR A CONTINUOUS SHEET

BACKGROUND OF THE INVENTION

1. Field of the Invention

The present invention relates to an intermittent feeding apparatus for feeding a continuous sheet that is applicable to a machine for processing a continuous sheet such as a flexorotary press, a flat plate rotary press, a rotary die cutter, a flat plate stamping machine, etc., and more particularly to an intermittent feeding apparatus for feeding a continuous sheet for successively performing printing of a predetermined size at the respective intervals alotted for printing of a roller paper sheet or other continuous sheets with any arbitrary print length within the range of a circumferential dimension of a plate drum of a rotary press printing machine.

2. Description of the Related Art

FIG. 17 shows a rotary press printing machine for a continuous sheet (hereinafter called simply "sheet") that is known in the prior art. With reference to this figure, a roll-shaped sheet 1 has its center portion pivotably supported by an unwinder 2 and is pulled by pull rolls 11 as nipped therebetween. The sheet 1 is unwound in the direction of the arrows and travels towards printing sections 10. The unwound sheet 3 passes between a printing drum 5 and a pressing drum 6 of each printing section 10 via a wrapping roll 4 and is thereby printed. In the illustrated example, three sets of printing sections 10 are shown, but in general there are provided printing sections for three to six colors depending upon the number of colors to be printed. The printed sheet 3 is pulled and pinched by a pair of pull rolls 11, and is then wound onto a roll 12 again by means of a winder 13.

In a printing mechanism shown in FIG. 18, ink 34 within an ink reservoir vessel 8 is transferred onto a surface of a printing plate 14 with the aid of an inking roll 7, and then printing is effected on the surface of the sheet 3. Excessive ink (ink exceeding a necessary amount) on the surface of the inking roll 7 is scraped away by means of a doctor blade 9, and is returned into the ink reservoir vessel 8. It is to be noted that the outer circumferential surface velocities of the pull rolls 11, pressing drum 6 and printing plate 14 are identical so that the traveling velocity of the sheet 3 may coincide with the surface circumferential velocity of the printing plate 14.

Furthermore, a braking device (not shown) for the roll 1 is mounted to the unwinder 2 so that slackening may not arise in the sheet 3 due to the fact that the sheet 3 is unwound to more than a necessary extent because of an inertia of the roll 1. In addition, the winder 13 is provided with a driving device (not shown) for the roll 12 for winding the sheet 3 fed from the pull rolls 11. A print length on a sheet in such a rotary press printing machine is determined by an arc length of the printing plate 14, and the maximum length of this arc length is the circumferential length $\pi D$ of the printing plate 14, where D represents the outer diameter of the printing plate 14.

Thus, the repeated print length is determined by the arc length of the printing plate 14, and in the case where the print length is smaller than the circumferential length $\pi D$ of the printing plate 14, blank portions where printing is not effected would be produced. These blank portions are quite unnecessary, and so, they are cut and thrown away in the subsequent step after the printing and winding. Accordingly, in the heretofore known machines, for the purpose of reducing these blank portions, the following proposals were made:

(I) A method of varying the outer diameter (D) of the plate drum 5 depending upon a print length, that is, a method of replacing the plate drum 5, was proposed.

(II) A method of vertically moving either the upper or lower roll rotating at a constant velocity depending upon a print length as shown in FIG. 19, was proposed. In the example illustrated in FIG. 19, during the period when the lower pull roll is raised the pull rolls nip the sheet to pull it, while during the period when the lower pull roll is lowered, the sheet stops. In other words, since printing is effected only when the sheet is traveling, a method of intermittently feeding a sheet in which the timing for raising and lowing the pull roll is varied depending upon a desired print length, was proposed.

(III) A method of intermittently feeding a sheet, in which a pulling member 35 for the sheet 3 is attached to one of the pull rolls 11 as shown in FIG. 20, the surface circumferential velocity of this pulling member 35 is made identical to the surface circumferential velocity of the printing plate 14, and further the arc length of the pulling member 35 is made larger than the arc length of the printing plate 14, was proposed.

While the above-described counter-measures (I), (II) and (III) have been heretofore proposed, they respectively involved the following problems:

Although the method (I) is a method which has been most commonly practiced, it has shortcomings that the replacement work for the plate drum which must be carried out each time a print length is varied, is troublesome and the printing mechanism is complex, and further, the largest shortcoming is that expensive plate drums having as many different circumferential as desired must be prepared, and hence a manufacturing cost of a printed sheet becomes high.

The method (II) is an improved counter-measure for eliminating the shortcoming of the method (I) (replacement of a plate drum being unnecessary). However, it also has shortcomings that since the sheet is pulled while being nipped between the pull rolls, a printed surface of a sheet which has been printed in the preceding step would be pressed by the pull roll, and hence ink which has either not yet been dried or not yet adhered to the surface of the sheet perfectly would be removed by the pull roll, or in some cases the printed surface of the sheet would be contaminated by the ink adhered to the surface of the pull roll. Moreover the vertically moving roll having a large inertia at a high frequency would result in mechanically unreasonable operations, which cause mechanical vibrations, and hence cannot operate properly in a high speed operation of the machine.

The method (III) is also an improved counter-measure for eliminating the shortcoming of the method (I) (replacement of a plate drum being unnecessary). However, since the sheet is pulled while being nipped similarly to the method (II), in this respect the method (III) has the similar shortcomings as does the method (II). In addition, it is necessary to replace the pulling member each time the print length is varied, hence pulling members having as many different arc lengths as desired need to be prepared, and so, this method has the same shortcoming as the method (I).

Furthermore, in the case where the pulling member is made of plastics, rubber, etc., there was a problem in durability, mainly in durability against abrasion (lowering of a sheet pulling force and reduction of a pulling dimension caused by abrasion, especially variation in the amount of slip when momentarily accelerating a stationary sheet would be directly related to the variety of repeat lengths of a sheet). In addition, there was a problem to be resolved upon practically embodying the method such that in the case of making the pulling member of metal, since high precision manufacturing is required, the manufacturing cost would become high.

SUMMARY OF THE INVENTION

The present invention has been proposed in view of the above-mentioned points, and it is one object of the present invention to provide an intermittent feeding apparatus for a continuous sheet which is simple in structure, includes a small number of movable members and accordingly is capable of high speed and high precision operation.

Another object of the present invention is to provide an intermittent feeding apparatus for a continuous sheet which does not necessitate replacement of parts when change in the intermittent feed length is desired, and which is less expensive as a whole.

Still another object of the present invention is to provide an intermittent feeding apparatus for a continuous sheet which facilitates the change an intermittent feed length of the sheet and hence can enhance a working efficiency.

The intermittent feeding apparatus for a continuous sheet according to the present invention is available in a machine for working (or processing) a continuous sheet while the continuous sheet travels through the machine, and is characterized in that the apparatus comprises a suction roll disposed on the downstream side of the working (or processing) section for sucking and transporting the continuous sheet, adjusting means for adjusting a sheet sucking and transporting period of the suction roll, and a suction box disposed on the upstream side of the working (or processing) section for continuously exerting upon the continuous sheet a suction force that is weaker than the suction force exerted by the suction roll. Therefore, the continuous sheet is made to travel by a differential force of the suction force of the suction roll minus the suction force of the suction box, but as the suction force of the suction roll is released by the adjust means the continuous sheet is stopped by the suction force of the suction box, and by repeating the above-mentioned operations the continuous sheet can be fed intermittently. Since an intermittent feed length can be changed by adjusting active and inactive intervals of the sheet suction force of the suction roll with the aid of the adjusting means, preparation of parts to be replaced as a result of such a change of an intermittent feed length is unnecessary. Hence, the apparatus is economical, and a working efficiency is also high. Inasmuch as transportation and intermittent feeding of a sheet are carried out by a suction force and its switching, the apparatus is simple in structure, movable members during working are few, and the, the apparatus is capable of high-precision and high-speed operation.

BRIEF DESCRIPTION OF THE DRAWINGS

Other features and objects of the present invention will become more apparent by reference to the following description of preferred embodiments of the invention as applied to a rotary press printing machine taken in conjunction with the accompanying drawings, wherein:

FIG. 1 is a side cross-sectional view of a rotary press printing machine for a continuous sheet according to a first preferred embodiment of the present invention, FIG. 2(*a*) is a detailed view of an essential part in FIG. 1, FIG. 2(*b*) is a diagrammatic view showing an outer circumferential dimension of a pull roll, FIG. 2(*c*) is a diagrammatic view showing an arc length dimension of the printing plate in FIG. 1.

DESCRIPTION OF THE PREFERRED EMBODIMENT

Figure 3:
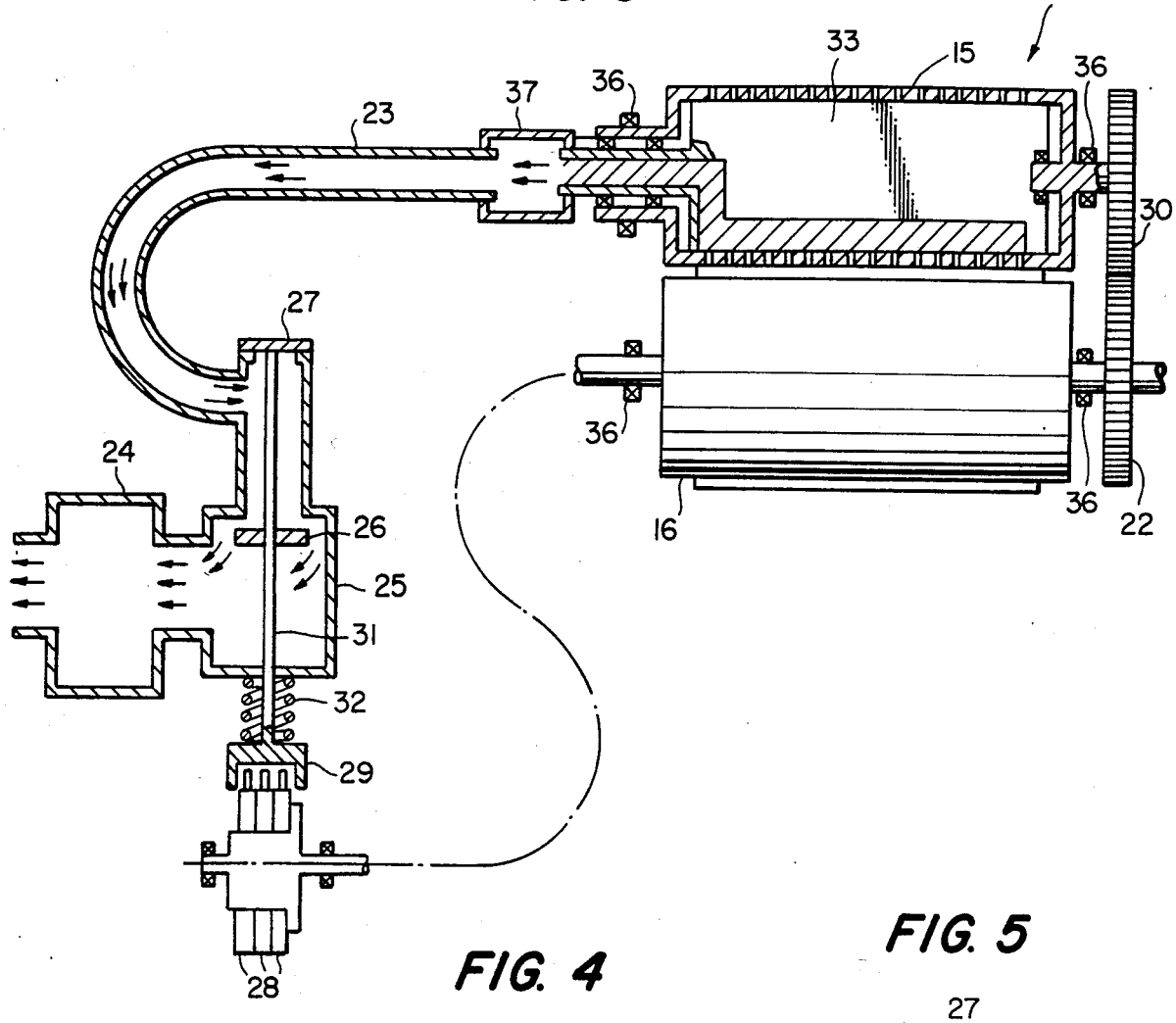
FIG. 3 is a front cross-sectional view showing details of a pull roll section in FIG. 1, FIGS. 4 and 5 are side cross-sectional views of an essential part in FIG. 3 in different operating states, respectively.

Referring now to the accompanying drawings, a general construction of a rotary press printing machine according to a first preferred embodiment of the present invention is illustrated in FIG. 1. A sheet 3 unwound from a roll 1 that is pivotably supported in an unwinder 2, is initially passed through printing sections 10, a pull roll section 21 and feed rolls 19 and is then wound onto a roll 12 by a winder 13. In each printing section 10, ink 34 stored within an ink reservoir vessel 8 is transferred by an inking roll 7 onto a surface of a printing plate 14, and printing is effected on the sheet 3 passing between a plate drum 5 and a pressing drum 6. A suction box 20 is disposed between the unwinder 2 and the printing sections 10, and it continuously sucks the traveling sheet 3 to achieve a braking effect caused by friction.

FIGS. 2 to 5 show details of the pull roll section 21, in which the sheet 3 is wrapped around a suction roll 15 that is hollow and has a large number of suction holes. A pull roll 16 is provided under the suction roll 15, and pulling members 17 and 18 for the sheet 3 are mounted on the pull roll 16. The mounting positions of the pulling members 17 and 18 are freely adjustable in the direction of rotation of the pull roll 16. The outer diameter D of the pulling members 17 and 18 is identical to the outer diameter D of the printing plate 14. As shown in FIGS. 2(*b*) and 2(*c*), the arc length dimension $L_2$ of the printing plate 14 is selected to be smaller than the outer circumferential dimension $L_1$ of the pulling members 17 and 18 including the intermediate absent interval (FIG. 2(*b*)), and further, the circumferential velocities of the both plate drum 5 and the pulling members 17 and 18 are also identical to each other (that is, they have the same rotational speed). In addition, the circumferential rotational velocities of the suction roll 15, the pulling members 17 and 18 and the printing plate 14 are also the same.

Explaining now with reference to FIG. 3, both the suction roll 15 and the pull roll 16 are rotatably supported via bearings 36, and the respective rolls are coupled with each other by intermediary gears 22 and 30 so that they may rotate at the same speed. Within the suction roll 15 is a suction partition member 33 so that suction may not be effected in an unnecessary circumferential region. The region where suction is made possible as a result of this suction partition member 33 is shown by hatching in FIGS. 2(*a*) and 3.

This suction partition member 33 is coupled to a suction duct 23 via a joint 37, and further, this suction duct 23 is connected to a suction chamber 25. The suction chamber 25 has the air contained therein sucked by a suction blower 24 which is always operating, and thus it is held at a pressure lower than the atmospheric pressure.

On the other hand, at one axial end of the pull roll 16 are mounted a plurality of cams 28 which rotate in synchronism with the pull roll 16, and the positions of these cams are adjustable in the direction of rotation. A cam follower 29 which is in contact with the cams 28 is mounted at one end of a piston shaft 31, which is continuously forced downward by a depressing force exerted by a spring 32, and therefore, the operations of being raised by the cams 28 and being lowered by the spring 32 are repeated for every revolution of the pull roll 16.

To the piston shaft 31 are mounted a suction valve 26 and an atmospheric releasing valve 27, and hence in the case where the piston 31 has been raised by the cams 28 via the cam follower 29 (FIG. 5), the path between the suction chamber 25 and the suction duct 23 is blocked by the suction valve 26, while the atmospheric releasing valve 27 is opened, so that the atmospheric air flows into the suction roll 15, the air pressure within the suction roll 15 becomes the atmospheric pressure, and thereby the pulling force acted upon the sheet 3 by the suction roll 15 is lowered (becomes smaller than the braking force exerted upon the sheet 3 by the above-mentioned suction box 20).

Figure 4:
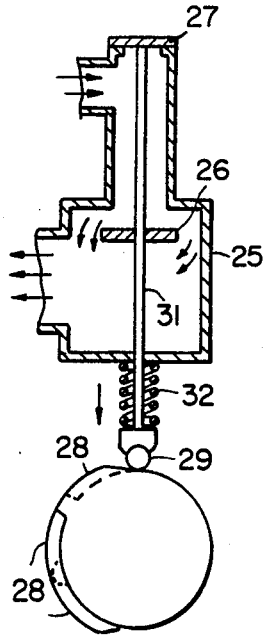
Figure 5:
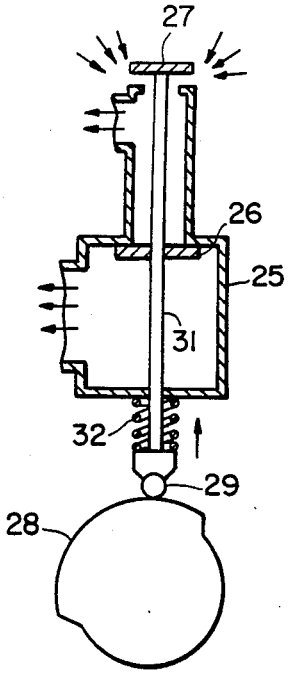

On the other hand, in the case where the piston 31 has been depressed by the spring 32 as shown in FIGS. 3 and 4, then the suction valve 26 is opened but the atmospheric releasing valve 27 is closed, and hence the pressure within the suction roll 15 becomes lower than the atmospheric pressure. The sheet 3 is brought into tight contact with the suction roll 15 as sucked by the latter, and therefore, it becomes possible that the sheet 3 is pulled against the braking force exerted by the suction box 20.

Explaining now the operation of the first preferred embodiment constructed in the above-described manner, the continuous sheet 3 is intermittently pulled, each time by the amount corresponding to the outer circumferential dimension $L_1$ between the pulling members 17 and 18 in the pull roll section 21. When the pulling force for the sheet 3 in the pull roll section 21 has ceased, the sheet 3 stops momentarily due to the suction force exerted by the suction box 20. Furthermore, the sheet 3 that is intermittently fed by the pull roll section 21, is continuously fed towards the winder 13 with the aid of sheet feed rolls 19.

Figure 6:
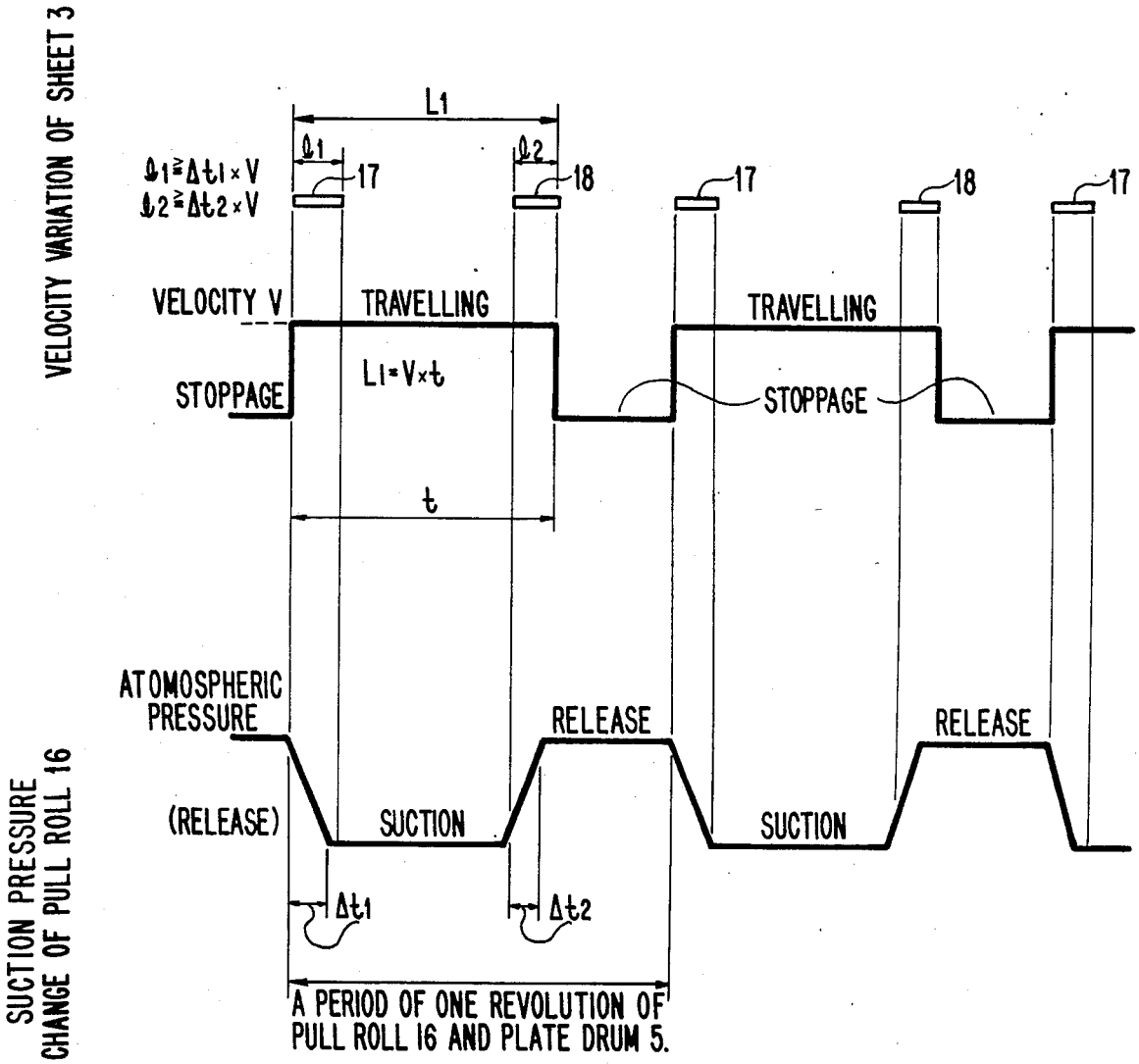
FIG. 6 is a diagrammatic view showing a velocity variation of a sheet and a suction pressure variation of a pull roll.

To account for the fact that the sheet 3 would repeatedly travel and stop as shown in FIG. 6, that is, it is fed intermittently, the winder 13 is automatically controlled to rotate at an average speed in response to a traveling amount (the outer circumferential dimension $L_1$) of the sheet fed during every revolution of the pull roll 16 [The sheet portion between the pull roll section 21 and the feed rolls 19 would sag as shown by a dash line in FIG. 1 during the period when the pull roll section 21 is pulling the sheet 3 (because the sheet pulling velocity of the pull roll section 21 is faster than the sheet pulling velocity of the feed rolls 19), but it would stretch as shown by a solid line after the sheet 3 has stopped. Such behaviors of the sheet portion are repeated for every revolution of the pull roll 16.] The printing plates 14 are mounted on the respective plate drums 5 so that printing may be effected during the period when the sheet 3 is travelling, as synchronized with the sheet 3.

It is to be noted that in the case of tri-color printing (provided with three sets of printing sections) as is the case with the illustrated embodiment, in order that printing points for the respective colors may coincide with each other, the positions of wrapping rolls 4*a* are adjusted as shown by dash lines in FIG. 1 so that the respective sheet lengths between a printing point A for a first color, a printing point B for a second color and a printing point C for a third color may coincide with a traveling amount of the sheet for each time (the outer circumferential dimension $L_1$).

In this way, the sheet 3 is intermittently fed by the pull roll section 21, printing is effected only during traveling of the sheet, a printable length is within a repeated feed length (an outer circumferential dimension $L_1$), and the sheet 3 is driven and controlled so that the respective relative printing positions may coincide with each other.

Figure 7:
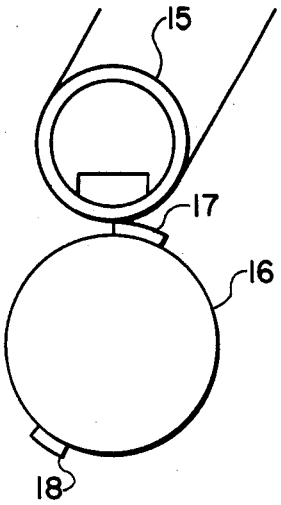
FIGS. 7, 8, 9, 10 and 11 are side views of the pull roll section in different operating states, respectively.
Figure 8:
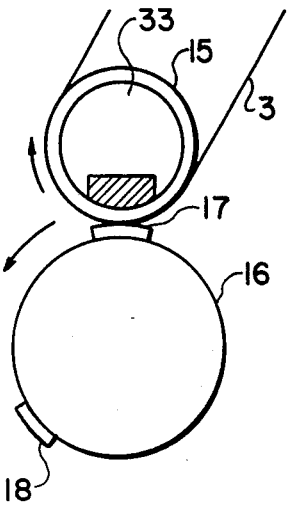

Now, description will be made as to the operation of the pull roll section 21 for intermittently feeding the sheet. At first, when the sheet 3 has been nipped between a leading edge of the front side pulling member 17 and the suction roll 15 as shown in FIG. 7, the sheet 3 begins to travel. At the same time, the interior of the suction roll 15 is sucked so as to be reduced to a pressure lower than the atmospheric pressure, and so, the sheet 3 is pulled by both the pulling member 17 and the suction force of the suction roll 15 as shown in FIG. 8 (within the range of the time interval $\Delta t_1$ shown in FIG. 6).

Figure 9:
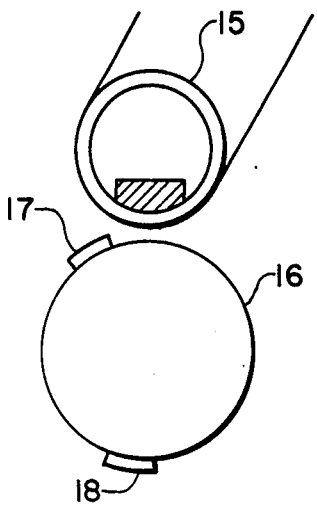
Figure 10:
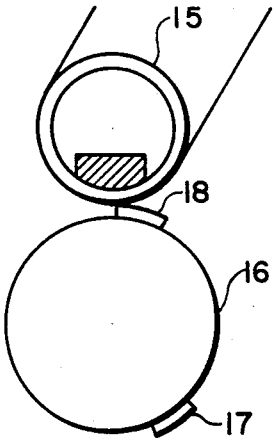
Figure 11:
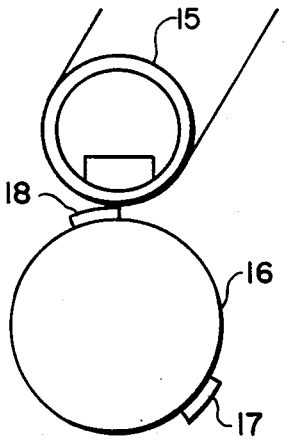

Subsequently, the rotation of the pull roll 16 proceeds. In the state shown in FIG. 9, the sheet is pulled by only the suction force of the suction roll 15. In the state shown in FIG. 10, that is, as soon as the rear side pulling member 18 and the suction roll 15 nip the sheet 3, the interior of the suction roll 15 has its pressure increased to be eventually the atmospheric pressure. Thus the suction force of the suction roll is gradually lowered, and therefore, the sheet 3 is pulled by the rear side pulling member 18 until the suction force ceases completely (within the range of the time interval $\Delta t_2$ in FIG. 6). Finally, in the state shown in FIG. 11, the pulling force for the sheet 3 is released, and so the sheet 3 stops. At this moment, the interior of the suction roll is perfectly restored to the atmospheric pressure, and the suction force for the sheet has disappeared.

It is to be noted that changing of the sheet feed length (the outer circumferential dimension $L_1$) is possible by changing the mounting position of the rear side pulling member 18 and at the same time varying the timing for releasing the suction roll 15 to the atmospheric pressure. In the following, the relation between the velocity variation of the sheet 3 caused by the front and rear pulling members 17 and 18 and the pressure change within the suction roll 15, will be explained in detail with reference to FIG. 6.

The upper portion of FIG. 6 shows the velocity variation of the sheet, while the lower portion thereof shows the pressure change within the suction roll. When the sheet 3 has been nipped between the front side pulling member 17 and the suction roll 15, the sheet velocity would momentarily become a rotational circumferential velocity V of the surfaces of the suction roll and the pulling member which was preliminarily adjusted and preset. At the same time, the air within the suction roll 15 is sucked out and the pressure in the suction roll 15 is gradually lowered. During the period before this pressure has been lowered to a preset pressure, that is, during the time interval $\Delta t_1$, the sheet 3 is surely nipped between the front side pulling member 17 and the suction roll 15. Here, it is to be noted that the arc length $l_1$ of the front side pulling member 17 is necessarily longer than $\Delta t_1 \times V$.

Subsequently, as soon as the sheet 3 is nipped between the leading edge of the rear side pulling member 18 and the suction roll 15, the suction effect for the interior of the suction roll 15 is released, and so, the pressure within the suction roll 15 is gradually restored to the atmospheric pressure. During this period, that is, during the time interval $\Delta t_2$, the sheet 3 is surely nipped between the rear side pulling member 18 and the suction roll 15. Hence, like the front side pulling member 17, the arc length $l_2$ of the rear side pulling member 18 is necessarily longer than $\Delta t_2 \times V$.

As will be obvious from the above description, in order to surely attain a constant feed length (the outer circumferential dimension $L_1$), the front and rear pulling members 17 and 18 take an important role (because with only the action of the suction roll 15 the timing for traveling and stoppage of the sheet 3 cannot be stabilized). It is to be noted that with regard to the effect of switching the pressure within the suction roll 15, as described previously it is achieved by actuating the valves 26 and 27 by the cams 28 which rotate in synchronism with the pull roll 16. In addition, since the cams 28 consist of a combination of a plurality of cams, it is possible to match the pressure switching with the outer circumferential dimension $L_1$ by changing the mounting positions of some of the cams 28 in the direction of rotation according to the change of the mounting position of the rear side pulling member 18, that is, according to the variation of the outer circumferential dimension $L_1$ as shown in FIG. 4.

Moreover, according to the above-described embodiment of the present invention, since the suction roll pulls the side of the sheet where printing was not effected, the contact length between the pulling members and the printed surface of the sheet within each repeated feed length is small, and hence the range where printing is limited taking into consideration the contamination of the sheet caused by the contact between the pulling members and the printed surface, is reduced.

Figure 13:
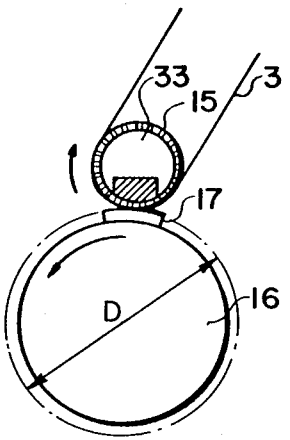
FIG. 13 is a side cross-sectional view showing the pull roll section in FIG. 12 in an enlarged scale.
Figure 14:
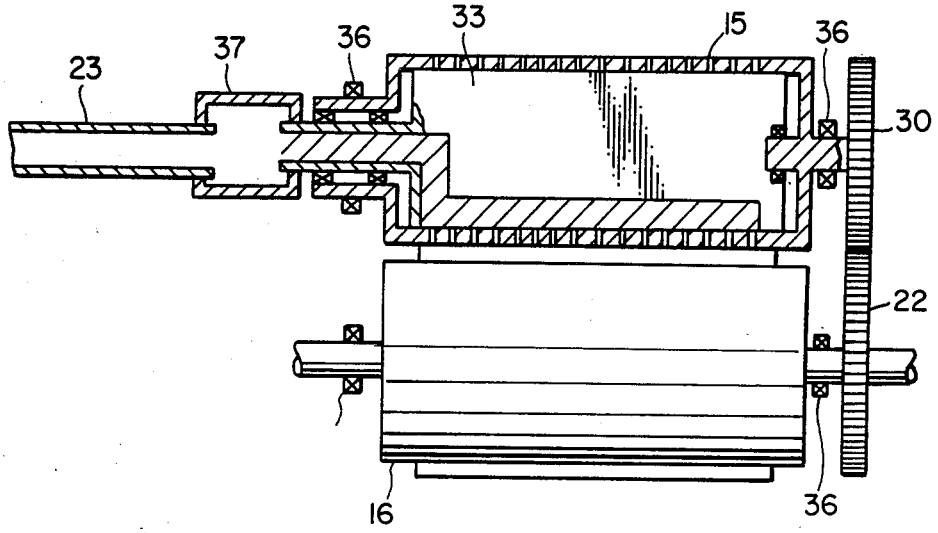
FIG. 14 is a front cross-sectional view of the pull roll section in FIG. 12.

Now, description will be made as to a second preferred embodiment of the present invention illustrated in FIG. 12. In this modified embodiment, the same reference numerals as those used in the first preferred embodiment designate like component parts, and so, further description thereof will be omitted. FIGS. 13 and 14 show a pull roll section 21, in which a single pulling member 17 is mounted on an outer circumferential surface of a pull roll 16. A suction partition member 33 provided within a suction roll 15 is connected to a suction duct 23 via a joint 37, and air in the suction roll 15 is sucked by a continuously operating suction blower not shown, so that the interior of the suction roll 15 is held at a pressure lower than the atmospheric pressure.

Figure 12:
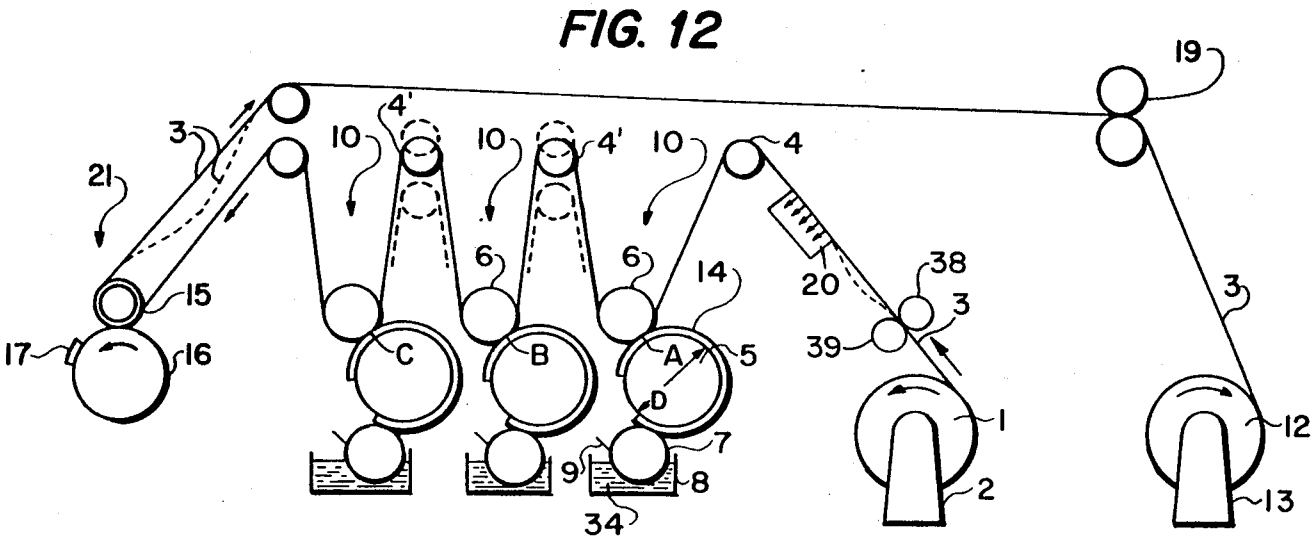
FIG. 12 is a side cross-sectional view of a rotary press printing machine according to a second preferred embodiment of the present invention.
Figure 15:
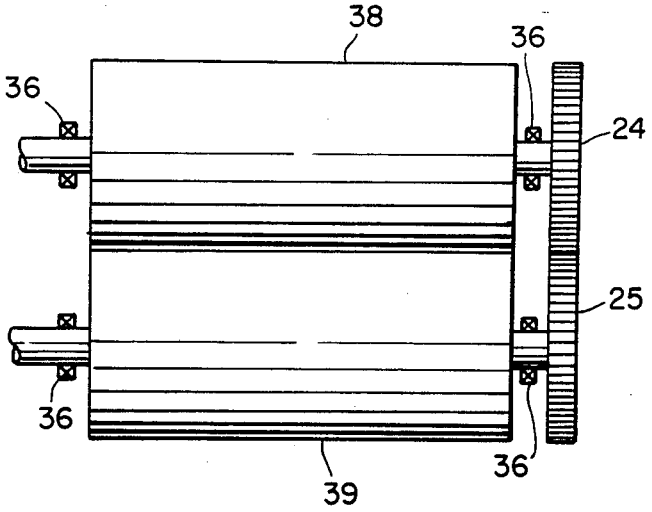
FIG. 15 is a front view showing the nip rolls in FIG. 12.

Nip rolls 38 and 39 provided between an unwinder 2 and a suction box 20 as shown in FIG. 12, will be described with reference to FIG. 15. The nip rolls 38 and 39 are both rotatably supported via bearings 36, and the respective rolls are coupled to each other through gears 24 and 25, respectively, so as to be rotated at the same speed. The nip rolls 38 and 39 are intermittently driven by a D.C. motor not shown while nipping the sheet 3 therebetween.

Now the operation of the second preferred embodiment constructed as described above will be explained. The continuous sheet 3 is continuously subjected to a pulling force $F_2$ in the direction of travel caused by a suction force of the suction roll 15 as well as a braking force $F_3$ in the opposite direction caused by a suction force of the suction box 20, and thereby a necessary tension is applied to the continuous sheet 3. In addition, in the pull roll section 21, when a pulling member 17 of the pull roll 16 engages with the sheet 3, a pulling force $F_1$ caused by the pulling member 17 acts upon the sheet 3, resulting in acceleration of the sheet 3. On the other hand, if the nip rolls 38 and 39 stops, a braking force $F_4$ caused by the nipping effect of the nip rolls 38 and 39 acts upon the sheet 3, resulting in stoppage of the sheet 3. The sheet 3 can be intermittently fed by making use of the above-described relationship, and it will be explained hereunder with reference to FIG. 16. In this particular figure, a period $\Delta t_1$ represents one cycle of the intermittent feeding of the sheet 3. A braking force caused by the suction box 20 is represented by $F_3$, a pulling force caused by the suction roll 15 is represented by $F_2$, and the pulling force $F_2$ is made equal to a sum of the braking force $F_3$ plus a necessary net pulling force $F_5$. In addition, a pulling force caused by the pulling member 17 is represented by $F_1$, a braking force caused by the nip rolls 38 and 39 is represented by $F_4$, and the braking force $F_4$ is preset so as to vary in the manner shown in FIG. 16.

Thereby, the sheet 3 is held a tension $T_1$ during the period $\Delta t_2$ and a tension $T_2$ during the period $\Delta t_3$.

Subsequently, the repeated intermittent traveling amount $L_1$ of the sheet 3 is made identical to the desired set amount $L_1$ by feedback control of the intermittent drive time cycle of the D.C. servo-motor for driving the nip rolls 38 and 39 and by automatic control of the time cycle and of the braking force $F_4$ caused by the nipping force, and further, change of the desired set amount $L_1$ is achieved by changing the above-described intermittent drive time cycle.

Figure 16:
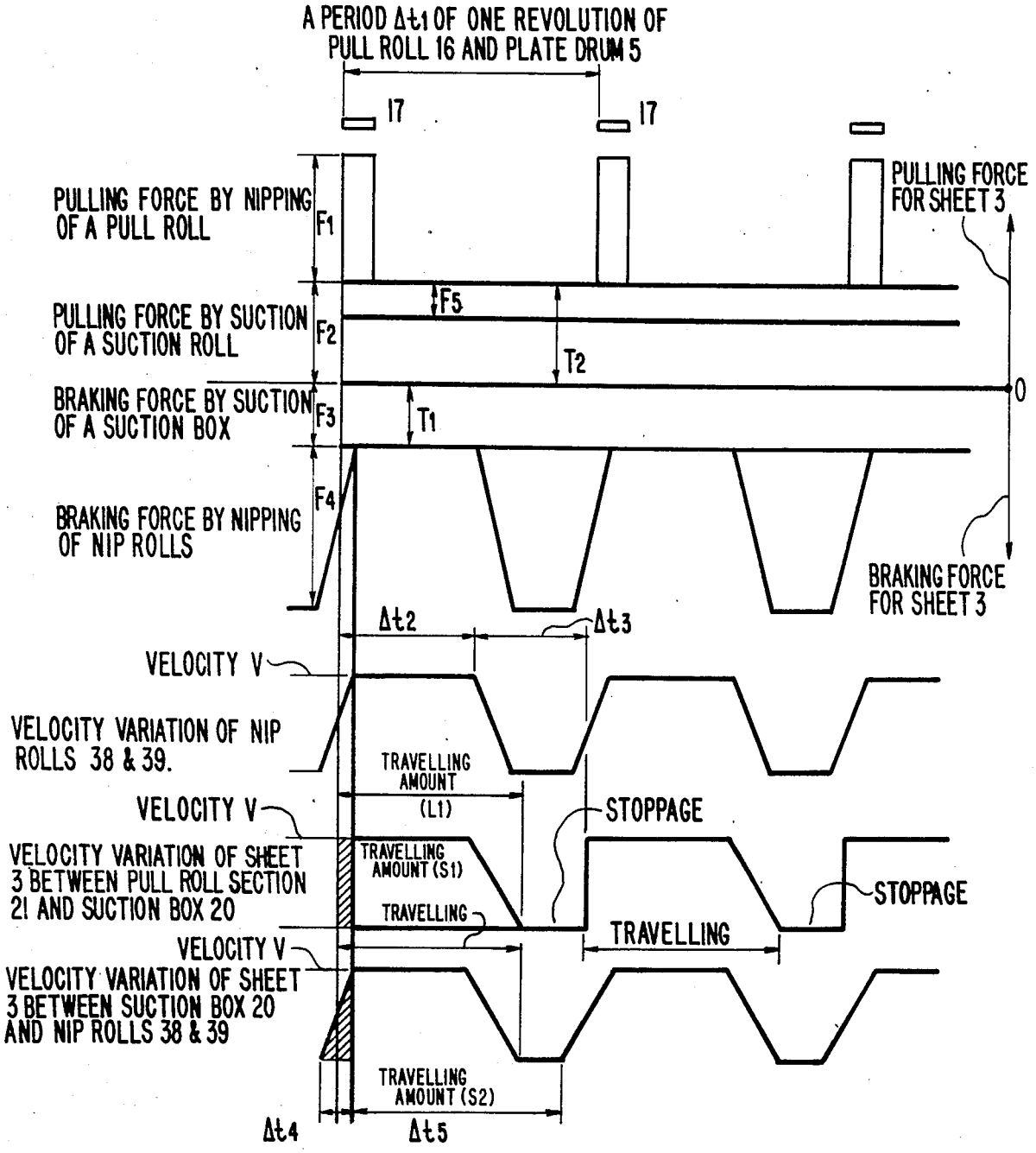
FIG. 16 is a diagrammatic view showing successive operating states of the second preferred embodiment.
Figure 17:
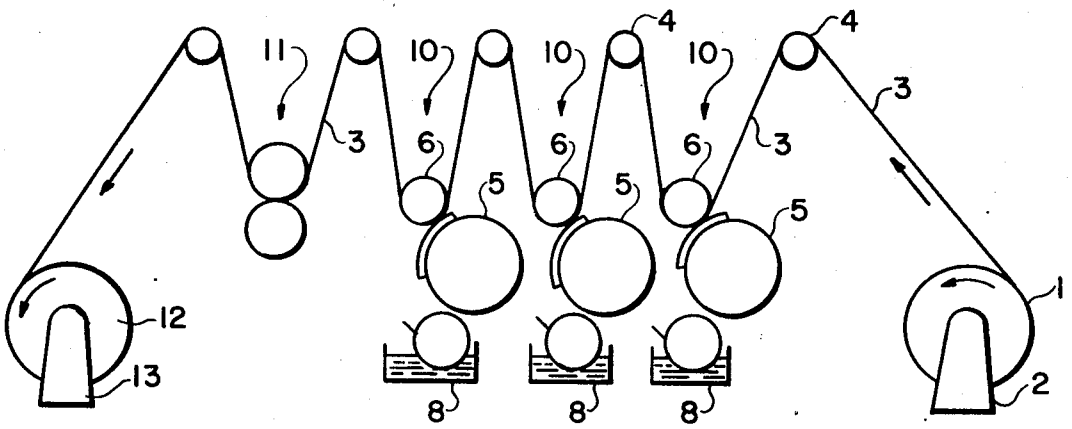
FIG. 17 is a side cross-sectional view showing a rotary press printing machine for a continuous sheet in the prior art.
Figure 20:
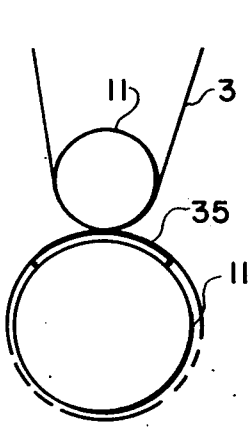
Figure 19:
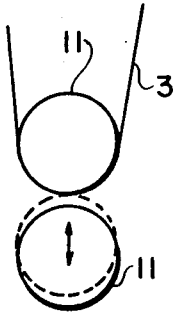
Figure 18:
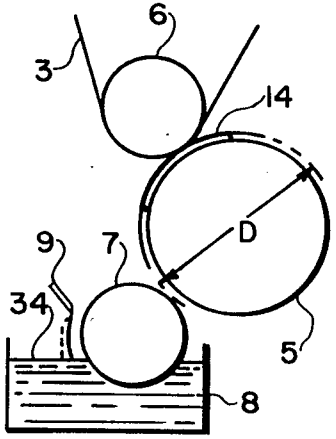
FIG. 18 is a detailed diagram of a printing section in FIG. 17, and FIGS. 19 and 20 are side views respectively showing different examples of a pull roll section in the prior art.

The sheet 3 which is fed intermittently in the above-described manner, is continuously fed to the winder 13 by means of sheet feed rollers 19. In consideration of the fact that the sheet 3 would repeatedly travel and stop as shown in FIG. 16, that is, would be fed intermittently, the winder 13 is automatically controlled so that it may be rotated at an average velocity corresponding to the traveling amount $L_1$ of the sheet that is fed for every revolution of the pulling roll 16.

In this case, between the pull roll section 21 and the feed rolls 19, the sheet 3 would sag as shown by a dash line in FIG. 12 during the period when the sheet 3 is being pulled by the pull roll section 21 (because the pulling velocity is faster than the sheet pulling velocity of the feed rolls 19), but it would be held in a tensioned state as shown by a solid line after stoppage of the sheet 3.

In addition, between the nip rolls 38 and 39 and the suction box 20, the sheet 3 would sag as shown by a dash line in FIG. 12 during the period before the pulling force $F_1$ caused by the pulling member 17 is exerted (during the time interval $\Delta t_4$) (because the nip rolls 38 and 39 are driven to release the braking force $F_4$ caused by nipping and thereby the sheet 3 is fed, before the pulling force caused by the pulling member 17 is exerted). During the period $\Delta t_5$ after the period $\Delta t_4$ has elapsed, that is, after the initial traveling amount $S_1$ of the sheet 3 between the pull roll section 21 and the suction box 20 has become equal to the traveling amount $S_2$ of the sheet 3 between the suction box 20 and the nip rolls 38 and 39, the sheet 3 takes a tensioned state as shown by a solid line in FIG. 12. Such an operation is repeated for every revolution of the pulling roll 16.

Then, adjustment is effected similarly to the above-described first preferred embodiment so that printing may be carried out during the period when the sheet 3 is travelling, in synchronism with the above-mentioned behavior of the sheet 3.

As described above, according to the second preferred embodiment, in addition to the advantages of the first preferred embodiment the following advantage can be obtained. That is, since the change of the feed length of the continuous sheet can be carried out by adjusting the timing of intermittent drive of the nip rolls, easy and highly precise adjustment becomes possible, and moreover, due to the fact that upon the change of the feed length adjustment, adjustment of the positions of the pulling members and the suction force and the like is unnecessary and an operation preparation time can be further reduced and hence a manufacturing cost of a printed sheet can be less. Furthermore, since a predetermined tension is continuously applied to the sheet, influence of a tension variation in the sheet caused by intermittent feeding is reduced, and further enhancement of a precision of the feed length of the continuous sheet becomes possible.

Since many changes and modification can be made in the above-described construction without departing from the spirit of the present invention, it is intended that all matter contained in the above description and illustrated in the accompanying drawings shall be interpreted to be illustrative and not as a limitation to the scope of the present invention.

What is claimed is:

1. An intermittent feeding apparatus for intermittently feeding a continuous sheet past a working or processing section in a machine for working or processing the continuous sheet, said apparatus comprising:

a rotatable suction roll downstream in the direction in which the sheet is fed from the processing section and over which the continuous sheet is fed, and drive means for rotating said suction roll during the intermittent feed of the sheet, said suction roll having a first suction means for intermittently exerting suction on the continuous sheet for alternately forcing the continuous sheet against said roll when the suction is exerted while said suction roll is rotated by said drive means to feed the sheet with the rotation of said suction roll and interrupting the exertion of suction on the sheet for a predetermined period of time while said suction roll is rotated;

a suction box upstream of said suction roll and over which the continuous sheet is fed, said suction box having a second suction means for exerting suction on the continuous sheet while said first suction means of the suction roll intermittently exerts suction on the sheet, the suction exerted by said second suction means being less than the suction being exerted on the sheet by said first suction means for allowing the sheet to be fed by the suction roll when said roll is rotated and said roll exerts suction on the sheet, and for forcing the sheet against said suction box to stop the feed of the sheet during said predetermined period of time; and a rotary pull roll adjacent said suction roll and between which said sheet is fed, said rotary pull roll having a first pulling member adjustably mounted along the outer periphery thereof for contacting said sheet to urge the sheet against said cylinder and coact therewith for feeding the sheet when suction is initially exerted by said first suction means, and a second pulling member adjustably mounted along the outer periphery of said pull roll for contacting the sheet to urge the sheet against said cylinder and coact therewith for feeding the sheet when the suction exerted by said first suction means is initially interrupted.

2. An intermittent feeding apparatus as claimed in claim 1 and further comprising, an adjusting means operatively connected to said first suction means for adjusting said predetermined period of time during which the exertion of suction on the sheet is interrupted and the feed of the sheet is stopped.

3. An intermittent feeding apparatus as claimed in claim 2, wherein said suction roll comprises a rotary hollow perforated cylinder and suction directing means within said cylinder for directing the suction exerted by said first suction means only on a portion of said cylinder over which the sheet is fed.

4. An intermittent feeding apparatus as claimed in claim 3, wherein said first suction means comprises a suction duct open to and communicating with the interior of said hollow perforated cylinder, a suction blower operatively connected to said suction duct for producing suction, and a valve between said suction blower and said suction duct, said valve being movable between a first open position for allowing suction produced by said suction blower to act through said duct and said cylinder to the sheet and a second closed position for preventing suction from acting through said duct and said cylinder to the sheet; and said adjusting means comprises valve positioning means for moving said valve to move between said first and second positions at an adjustable predetermined rate.

* * * * *